United States Patent [19]

Seager

[11] Patent Number: 4,915,528

[45] Date of Patent: Apr. 10, 1990

[54] SOLID STICK DISPENSER SUITABLE FOR TOP OR BOTTOM FILLING

[75] Inventor: Richard H. Seager, Mystic, Conn.

[73] Assignee: Risdon Corporation, Naugatuck, Conn.

[21] Appl. No.: 347,529

[22] Filed: May 4, 1989

[51] Int. Cl.[4] ..... A45D 40/06

[52] U.S. Cl. ..... 401/68; 264/279; 401/175

[58] Field of Search ..... 401/68, 175, 171, 172, 401/174, 69, 178, 75; 264/279

[56] References Cited

U.S. PATENT DOCUMENTS

| | | | |
|---|---|---|---|
| 1,472,685 | 10/1923 | Schumacher . | |
| 1,540,090 | 6/1925 | Shapiro . | |
| 2,554,287 | 5/1951 | Wilson | 222/378 |
| 2,818,167 | 12/1957 | McKinley | 206/56 |
| 2,980,246 | 4/1961 | Leshin | 206/56 |
| 3,907,441 | 9/1975 | Idec et al. | 401/75 |
| 4,232,977 | 11/1980 | Chutter | 401/68 |
| 4,298,036 | 11/1981 | Horvath | 141/1 |
| 4,363,560 | 12/1982 | Gentile | 401/68 |
| 4,369,158 | 1/1983 | Woodruff et al. | 264/268 |
| 4,521,127 | 6/1985 | Tomburo et al. | 401/68 |
| 4,545,696 | 10/1985 | Carluccio | 401/175 |
| 4,552,161 | 11/1985 | Hill et al. | 132/88.5 |
| 4,580,920 | 4/1986 | Schmidt | 401/175 |
| 4,595,124 | 6/1986 | Duval et al. | 222/39 |
| 4,605,330 | 8/1986 | Crowley et al. | 401/68 |
| 4,621,935 | 11/1986 | Sussman | 401/82 |
| 4,664,547 | 5/1987 | Rosenwinkel | 401/175 |
| 4,700,448 | 10/1987 | Parker | 29/434 |
| 4,702,399 | 10/1987 | Davis | 222/390 |

FOREIGN PATENT DOCUMENTS

| | | | |
|---|---|---|---|
| 2807472 | 8/1979 | Fed. Rep. of Germany | 401/175 |

*Primary Examiner*—Richard J. Johnson

*Attorney, Agent, or Firm*—St. Onge Steward Johnston & Reens

[57] ABSTRACT

The present invention relates to a dispenser of the propel/repel type, typically used for solid stick deodorants. The dispenser includes a container, a piston mounted on a threaded rod, and an actuating wheel to rotate the rod and either advance the piston toward a product outlet or retracted it away from the outlet. Filling with molten deodorant material can be effected either through the top (i.e., the product outlet) or the bottom of the dispenser. When top-filling, the container is filled through the product outlet, while the piston is fully retracted. Alternatively, the container can be bottom-filled with a cover over the product outlet simply by advancing the piston slightly toward the product outlet, injecting molten deodorant material through openings in the piston and container, and fully retracting the piston to close the filling openings. Once filled by either technique, the dispenser contents are allowed to cool and solidify.

40 Claims, 2 Drawing Sheets

SOLID STICK DISPENSER SUITABLE FOR TOP OR BOTTOM FILLING

BACKGROUND OF THE INVENTION

Propel/repel dispensers have been used for some time to house and dispense solid materials such as deodorant sticks. Such devices generally include a container with a product outlet, a cover over the outlet, a piston to advance or retract the material being dispensed toward or away from the outlet, respectively, and means to effect such advancement or retraction.

Often, propel/repel dispensers are top-filled with molten deodorant material through the product outlet with the piston fully retracted from the outlet. The deodorant material is then allowed to cool and solidify as a stick shaped like the interior of the dispenser. However, during such solidification, the stick contracts, causing the top to assume a concave, uneven appearance. Further, top-filled solid stick deodorants tend to dry out due to their contact with air even before actual use. Examples of solid stick dispensers suitable for top filling include: U.S. Pat. No. 2,818,167 to McKinley; U.S. Pat. No. 2,980,246 to Leshin; U.S. Pat. No. 3,907,441 to Idec; U.S. Pat. No. 4,232,977 to Chutter; U.S. Pat. No. 4,363,560 to Gentile; U.S. Pat. No. 4,521,127 to Tomburo et al.; and U.S. Pat. No. 4,580,920 to Schmidt.

To avoid the problems encountered with top-filled dispensers, it has been proposed to place a cover with a molding surface over the product outlet of a solid stick dispenser and then fill the dispenser through the bottom. As the molten material cools and solidifies, the resulting stick assumes the smooth, attractive configuration of the interior of the container and molding surface. Bottom-filling has the added advantage of limiting the deleterious exposure of the deodorant stick to air.

One technique of bottom-filling is to fill the container through its bottom before the stick advancement mechanism is installed. After filling is completed, but before solidification of the material to be dispensed, the stick advancement mechanism is installed. Examples of such bottom-filled dispensers include: U.S. Pat. No. 4,369,158 to Woodruff et al.; U.S. Pat. No. 4,552,161 to Hill et al.; U.S. Pat. No. 4,595,124 to Duval et al.; U.S. Pat. No. 4,621,935 to Sussman; U.S. Pat. No. 4,664,547 to Rosenwinkel; U.S. Pat. No. 4,700,448 to Parker; and U.S. Pat. No. 4,702,399 to Davis.

Filling solid stick dispensers before they are completely assembled and then subsequently completing assembly is a common, but complicated and messy procedure. It has, therefore, been desired to produce a dispenser which can be bottom-filled when fully assembled, as disclosed by U.S. Pat. No. 4,298,036 to Horvath ("Horvath"), U.S. Pat. No. 4,545,696 to Carluccio ("Carluccio"), and U.S. Pat. No. 4,605,330 to Crowley et al. ("Crowley").

In the dispenser of Horvath, liquid product is poured through a screw stem and flows into the container through a rectangular opening. After the product is solidified, a bottom plug is inserted.

In Carluccio's dispenser, a product is charged into the container from its bottom through aligned fill holes. After filling is completed, a plug is snapped into place.

Crowley's dispenser is filled from the bottom through a bore, skeletal mounting means, and the skeletal structure of a follower. After filling is completed, a closure seal is installed to cover the bore.

In the dispensers of Horvath, Carluccio, and Crowley, the passages for bottom-filling cannot themselves be closed—i.e., they are always available for fluid passage. The dispenser must, therefore, be held in an inverted position until the molten deodorant material has solidified and a plug installed. Use of a plug increases manufacturing costs by requiring an additional component part and additional manufacturing steps.

SUMMARY OF THE INVENTION

The present invention relates to a solid stick dispenser which can be top-filled or bottom-filled. The dispenser includes a container defining a chamber for storing material to be dispensed which extends between a base and an outlet end. A piston is positioned within the container to advance or retract material to be dispensed relative to the outlet end. Axial movement of the piston is accomplished by means of a threaded rod extending through the dispenser coupled to an actuating wheel for turning the rod to effect such advancement or retraction. Both the piston and actuating wheel are provided with passages to permit material to be injected into the dispenser through its bottom. To permit venting of gases displaced by the injected material, the piston is also provided with vent holes. The container has structure to close both the filling passages and vent holes in the piston after filling is completed. The product outlet end of the container is enclosed by a cover which may be provided with a product molding surface to shape the material as it is filled into the dispenser.

Top-filling is accomplished by placing the container in an upright orientation and removing its cover. Molten deodorant material is then injected into the container while the piston is fully retracted. After being allowed to cool, the molten deodorant material solidifies.

Bottom-filling is achieved by placing the cover and molding surface over the container outlet and inverting the container. With the piston slightly advanced, molten deodorant material is injected into the dispenser chamber through passages in the actuating wheel and piston. In this slightly advanced state, the vent holes of the piston are also opened to permit displacement of gases. After filling is completed, the piston is fully retracted to close the vent openings and product filling passages. The molten deodorant material then cools and solidifies into a product stick with a smooth attractive appearance.

BRIEF DESCRIPTION OF THE INVENTION

DETAILED DESCRIPTION OF THE DRAWINGS

Figure 1:
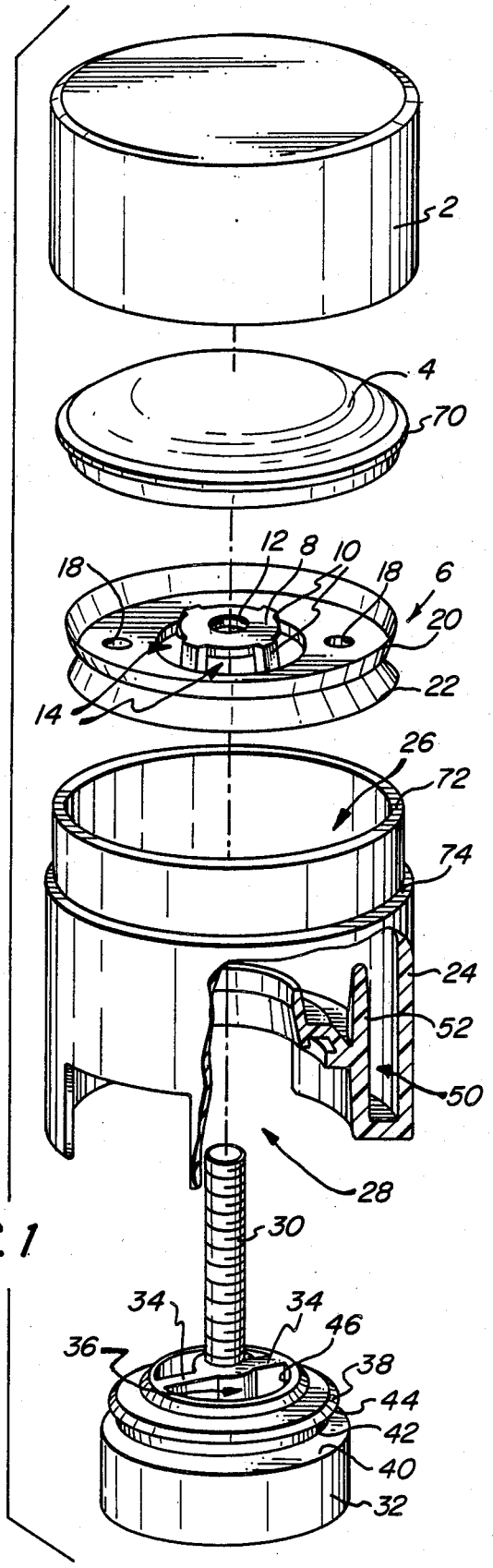
FIG. 1 is a partially cut-away, exploded, perspective view of a fully assembled dispenser in accordance with the present invention.

FIG. 1 is a partially cut-away, exploded, perspective view of a dispenser in accordance with the present invention. This dispenser is provided with a cover 2 which is placed on cover seat 74 of barrel 24 to enclose top opening 26. Fitted between cover 2 and barrel 24 is finishing cap 4, having ledge 70 which rests upon finishing cap seat 72.

Fitted within barrel 24 is piston 6 having central ring 8 through which threaded opening 12 extends. Central ring 8 is connected to lower ledge 16 (see FIGS. 3 and 4) of piston 6 by means of connection bars 10. Between connection bars 10 are product passages 14 which are useful in bottom-filling barrel 24. Radially displaced from threaded opening 12 are vent openings 18. Circumferentially positioned on piston 6 is upper wiping surface 20 and lower wiping surface 22 which sealingly engage the inner walls of barrel 24 to prevent leakage of material around piston 6.

Piston 6 is mounted at threaded opening 12 on threaded rod 30. As a result, rotation of threaded rod 30 causes the advancement or retraction of piston 6 within barrel 24. Threaded rod 30 is mounted to actuating wheel 32 so that rotation of actuating wheel 32 causes threaded rod 32 to turn. Threaded rod 30 is connected to actuating wheel 32 by means of wall 34 which with inner wall 46 of actuating wheel 32 defines product passages 36. When the dispenser of the present invention is fully assembled, actuating wheel 32 can, be accessed and rotated through wheel opening 28 in barrel 24. Actuating wheel 32 is provided with upper fill seal surface 38, lower fill seal surface 40, lock groove 42, and lock abutment 44 to lock actuating wheel 32 to barrel 24 in a sealed fashion.

As shown by the cut-away portion of barrel 24 in FIG. 1, vertical wall 52 extends upwardly from base wall 48 and terminates with vent seal portion 54. Branching from vertical wall 52 is structure to lockingly seal actuating wheel 32 to the bottom of barrel 24. This structure includes lower fill seal surface 56, lock abutment 58, lock groove 60, and upper wall 62.

Figure 2:
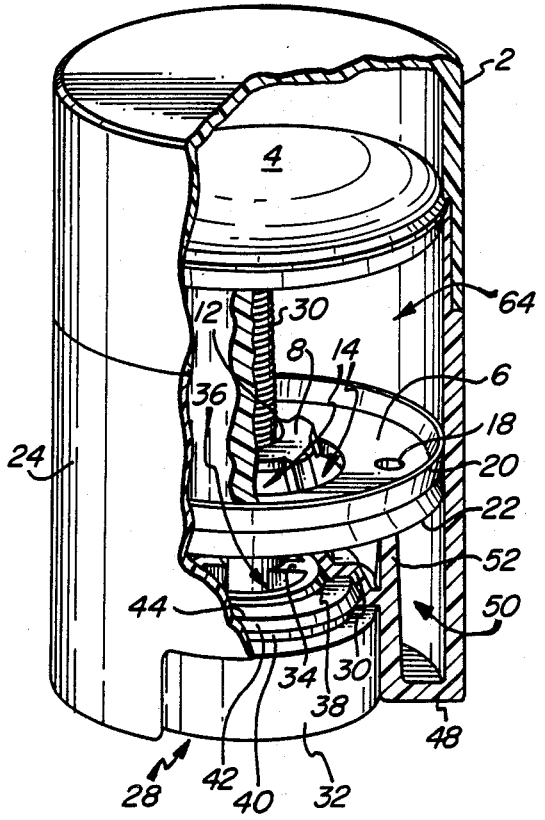
FIG. 2 is a partially cut-away perspective view of a fully assembled dispenser according to the present invention.

FIG. 2 is a partially cut-away perspective view of a fully assembled dispenser in accordance with the present invention. As this figure shows, cover 2 is mounted on barrel 24 with finishing cap 4 fitted between them. In addition, piston 6 is mounted within barrel 24 on threaded rod 30 by means of threaded opening 12 in central ring 8. This permits piston 6 to be advanced or retracted within product chamber 64, depending on the direction actuating wheel 32 is turned. Actuating wheel 32 is connected to barrel 24 in a locking and sealing fashion by walls within barrel 24. These inner walls are connected to barrel 24 by means of base wall 48. Vertical walls 52, base wall 48, and the exterior wall of barrel 24 collectively define base chamber 50.

Figure 4:
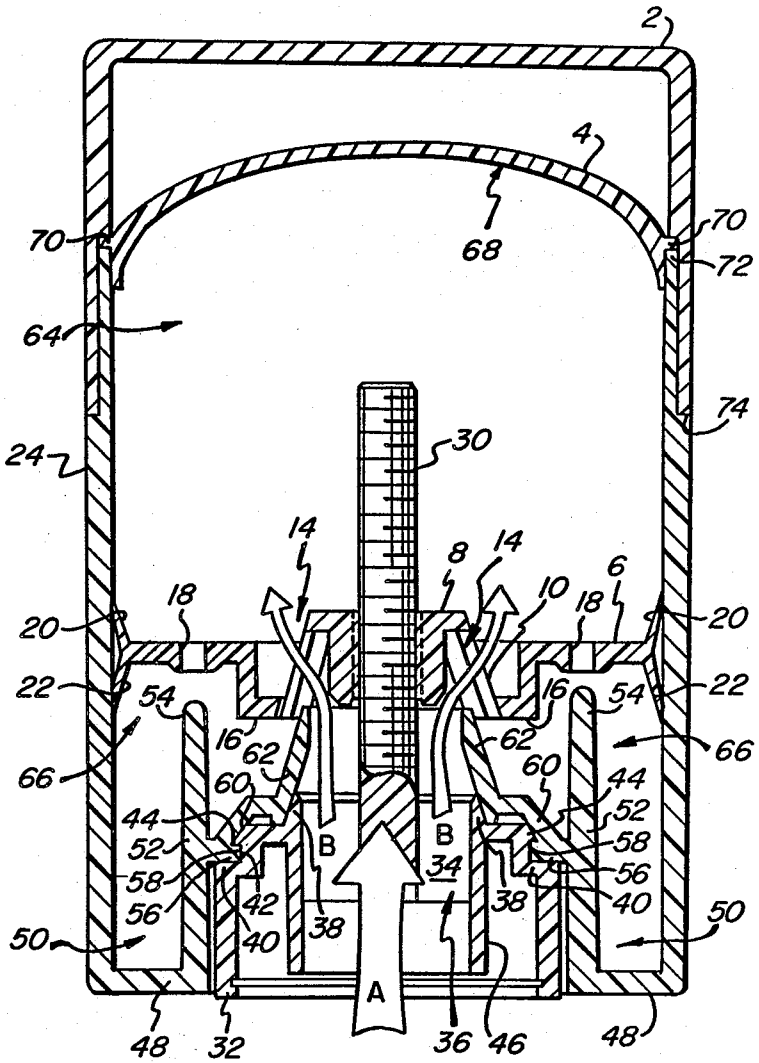
FIG. 4 is a side cross-sectional view of a dispenser according to the present invention with its product advancing piston in an advanced position to permit bottom-filling.
Figure 3:
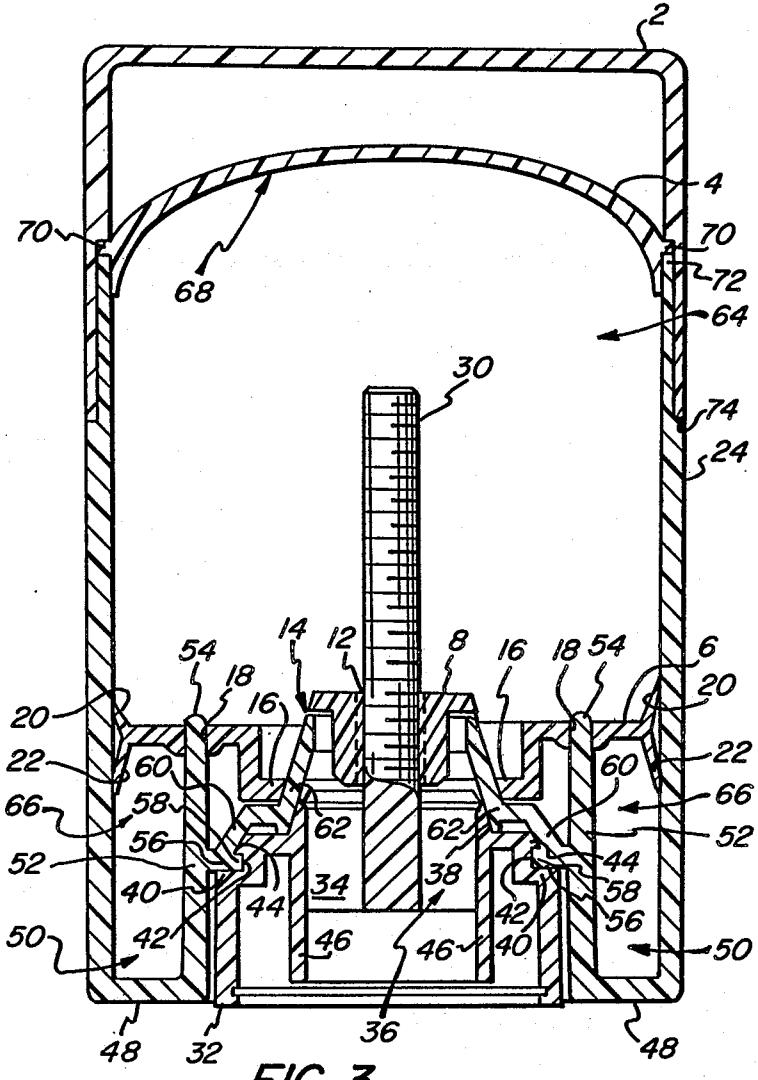
FIG. 3 is a side cross-sectional view of a dispenser according to the present invention with its product advancing piston in a fully retracted position.

The present invention in fully assembled form is shown in more detail in FIGS. 3 and 4 which are side cross-sectional views. Actuating wheel 32 is connected to barrel 24 by the locking engagement of lock groove 42 with lock abutment 58 and lock abutment 44 with lock groove 60. To permit bottom-filling, this locking engagement of actuating wheel 32 with the walls within barrel 24 has sufficiently close tolerances to effect sealing between contacting parts. For example, upper fill seal surface 38 of actuating wheel 32 contacts upper wall 62 to form an upper seal, while lower fill seal surface 40 of actuating wheel 32 contacts lower fill seal surface 56 to form a lower seal.

FIGS. 3 and 4 also illustrate how passages for bottom-filling are opened and closed. When actuating wheel 32 is rotated to retract fully piston 6 on threaded rod 30, upper wall 62 engages central ring 8 and lower ledge 16 to close product passages 14, as shown in FIG. 3. In addition, vent seal portions 54 of vertical walls 52 sealingly close vent openings 18. When piston 6 is upwardly advanced along threaded rod 30, as shown in FIG. 4, by rotation of actuating wheel 32, ledge 16 and central ring 8 move away from upper wall 62 and vent openings 18 move away from vent seal portions 54 to open product passages 14 and vent openings 18, respectively. Bottom-filling of molten deodorant material and consequent displacement of gas within product chamber 64 can then be effected. Product is injected through a product feeding path defined by the chamber within inner wall 46, product passages 36 defined by wall 34 and inner wall 46, the chamber defined by upper wall 62, and product passages 14 of piston 6.

The pressing engagement of ledge 70 of finishing cap 4 between finishing cap seat 72 of barrel 24 and cover 2 is also shown in more detail in FIGS. 3 and 4. By securing finishing cap 4 in this fashion, the product stick formed within product chamber 64 by bottom-filling will assume a smooth, contoured top configuration corresponding to molding surface 68.

Prior to filling, the dispenser of the present invention is assembled. First, actuating wheel 32 is connected to barrel 24 by fitting lock abutment 44 within lock groove 60 and lock abutment 58 within lock groove 42. Piston 6 is then mounted to threaded rod 30 by means of threaded opening 12. Next, finishing cap 4 is placed on barrel 24 so that ledge 70 rests upon finishing cap seat 72. Cover 2 can then be placed over finishing cap 4 and top opening 26 of barrel 24 so that it rests upon cover seat 74.

When top-filling the dispenser of the present invention, piston 6 is fully retracted within barrel 24, as shown in FIG. 3. After cover 2 and finishing cap 4 are removed from top opening 26, molten deodorant material is poured into barrel 24 through top opening 26. With piston 6 fully retracted, upper wall 62 closes product passages 14, while vent seal portions 54 sealingly shut vent openings 18. As a result, substantially no molten deodorant material leaks below piston 6 during filling and solidification. Once the molten material solidifies to form a stick, there is little danger of such leakage and piston 6 can be freely advanced or retracted within barrel 24.

When bottom-filling the dispenser of the present invention, it is inverted with cover 2 and finishing cap 4 fitted over top opening 26 and piston 6 is advanced from the fully retracted position shown in FIG. 3 to the position shown in FIG. 4. As a result, upper wall 62 is no longer blocking product passages 14 and vent seal portions 54 are no longer obstructing vent openings 18. In this position, molten deodorant material can be charged through the bottom of the dispenser into the chamber defined by inner wall 46 as shown by arrow A. The injected material then moves through product passages 36 defined by wall 34 and inner wall 46. From product passages 36, material to be dispensed follows the path defined by arrows B—i.e., through the chamber defined by upper wall 62, through product passages 14, and into product chamber 64. The filling of product chamber 64 with molten deodorant material necessitates the displacement of previously-present gases through vent openings 18. Bottom-filling continues until product chamber 64 is full and some molten material has actually passed through vent openings 18 into fill chamber 66. When filling is completed, piston 6 is retracted to the position shown in FIG. 3. Despite such retraction, product chamber 64 remains filled with molten material, because the downward movement of piston 6 causes molten material in fill chamber 66 to pass into product chamber 64 through vent openings 18. Once piston 6 is returned to its fully retracted position shown in FIG. 3, the dispenser can be returned to an upright orientation and the contents of product chamber 64 allowed to cool and solidify. No bottom plug is needed. Such cooling and solidification causes the stick product to assume the configuration of the interior of barrel 24 as well as molding surface 68.

Regardless of whether the dispenser of the present invention is top-filled or bottom-filled, it can be used simply by removing both cover 2 and finishing cap 4 and rotating actuating wheel 32 to advance both piston 6 and the product. After use, actuating wheel 32 is rotated in an opposite direction to retract piston 6 and cover 2 and finishing cap 4 are then again placed over the product.

Although the invention has been described in detail for the purpose of illustration, it is understood that such detail is solely for that purpose, and variations can be made therein by those skilled in the art without departing from the spirit and scope of the invention which is defined by the following claims.

What is claimed is:

1. A dispenser suitable for top- or bottom-filling comprising:

a container defining a chamber for storing material to be dispensed and extending between a base end and an outlet end;

a piston positioned within said container and having fluid passage means to enable fluid to pass through said piston;

actuation means positioned to move said piston within the chamber between a retracted position adjacent the base end and a fully advanced position adjacent the outlet end;

passage closure means attached to said container and positioned proximate to the base end to close the fluid passage means when said piston is in the retracted position but not when said piston is moved toward the advanced position; and feed passage means adapted for directing fluids from the base end, past said passage closure means, through the fluid passage means, and into the chamber when said piston is advanced from the retracted position.

2. A dispenser according to claim 1 further comprising:

a threaded rod extending substantially between the base end and the outlet end, wherein said piston is mounted on said threaded rod by means of a threaded opening in said piston and said actuation means imparts rotation to said threaded rod which causes said piston to move along said threaded rod.

3. A dispenser according to claim 1 further comprising:

an upper molding surface attached to the outlet end of said container.

4. A dispenser according to claim 3 further comprising:

a cap removably positioned on said container over the outlet end, wherein said upper molding surface is attached to said cap.

5. A dispenser according to claim 2, wherein said actuating means comprises:

an actuating wheel positioned proximate the base end and coaxially mounted to said threaded rod, whereby rotation of the actuating wheel turns said threaded rod.

6. A dispenser according to claim 5, wherein the actuating wheel has a hollow interior which defines at least part of said feed passage means.

7. A dispenser according to claim 5, wherein said container has one or more cut-out portions proximate the bottom end to access and turn the actuating wheel.

8. A dispenser according to claim 2, wherein the fluid passage means is positioned on said piston around and adjacent the threaded opening.

9. A dispenser according to claim 8, wherein said passage closure means extends substantially vertically from the bottom end toward the outlet end.

10. A dispenser according to claim 9 further comprising:

a substantially horizontal base wall proximate the base end and connecting said container and said passage closure means.

11. A dispenser according to claim 9, wherein the fluid passage means of said piston slides over said passage closure means when said piston is in the retracted position.

12. A dispenser according to claim 1 wherein said passage closure means extends substantially vertically from the base end toward the outlet end.

13. A dispenser according to claim 12 further comprising:

a substantially horizontal base wall proximate the base end and connecting said container and said passage closure means.

14. A dispenser according to claim 12, wherein the fluid passage means of said piston slides over said passage closure means when said piston is in the retracted position.

15. A dispenser according to claim 12, wherein the actuating wheel has a hollow interior which defines at least part of said feed passage means.

16. A dispenser according to claim 15, wherein the actuating wheel has an upper exterior surface which is sealingly attached to said passage closure means.

17. A dispenser suitable for top- or bottom-filling comprising:

a container defining a chamber for storing material to be dispensed and extending between a base end and an outlet end;

a piston positioned within said container and having vent opening means to enable fluid to pass through said piston;

actuation means positioned to move said piston within the chamber between a retracted position adjacent the base end and a fully advanced position adjacent the outlet end;

feed means adapted for directing fluids from the base end, past said piston, and into the chamber; and vent seal means attached to said container and positioned proximate to the base end to close the vent opening means when said piston is in the retracted position but not when said piston is advanced from the retracted position, whereby fluids will pass through the vent opening means when the chamber is filled through said feed means and said piston is advanced from the retracted position.

18. A dispenser according to claim 17 further comprising:

a threaded rod extending substantially between the base end and the outlet end, wherein said piston is mounted on said threaded rod by means of a threaded opening in said piston and said actuation means imparts rotation to said threaded rod which causes said piston to move along said threaded rod.

19. A dispenser according to claim 17 further comprising:

an upper molding surface attached to the outlet end of said container.

20. A dispenser according to claim 19 further comprising:

a cap removably positioned on said container over the outlet end, wherein said upper molding surface is attached to said cap.

21. A dispenser according to claim 18, wherein said actuating means comprises:

an actuating wheel positioned proximate the base end and coaxially mounted to said threaded rod, whereby rotation of the actuating wheel turns said threaded rod.

22. A dispenser according to claim 18, wherein the vent opening means is circumferentially spaced around the threaded opening.

23. A dispenser according to claim 22, wherein said vent seal means extends substantially vertically from the base end toward the outlet end.

24. A dispenser according to claim 23, wherein said vent seal means projects into the vent opening means when said piston is in the retracted position.

25. A dispenser according to claim 23 further comprising:

a substantially horizontal base wall proximate the base end and connecting said container and said vent seal means.

26. A dispenser according to claim 17, wherein said vent seal means extends substantially vertically from the base end toward the outlet end.

27. A dispenser according to claim 26, wherein said vent seal means projects into the vent opening means when said piston is in the retracted position.

28. A dispenser according to claim 26 further comprising:

a substantially horizontal base wall proximate the base end and connecting said container and said vent seal means.

29. A dispenser suitable for top- or bottom-filling comprising:

a container defining a chamber for storing material to be dispensed and extending between a base and an outlet end;

a piston positioned within said container and having fluid passage means and vent opening means to enable fluid to pass through said piston;

actuation means positioned to move said piston within the chamber between a retracted position adjacent the base end and a fully advanced position adjacent the outlet end;

passage closure means attached to said container and positioned proximate to the base end to close the fluid passage means when said piston is in the retracted position but not when said piston is moved toward the advanced position;

feed passage means adapted for directing fluids from the base end, past said passage closure means, through the fluid passage means, and into the chamber when said piston is advanced from the retracted position; and vent seal means attached to said container and positioned proximate to the base end to close the vent openings when said piston is in the retracted position but not when said piston is advanced from the retracted position, whereby fluids will pass through the vent openings when the chamber is filled through said feed passage means and said piston is advanced from the retracted position.

30. A dispenser according to claim 29 further comprising:

a threaded rod extending substantially between the base end and the outlet end, wherein said piston is mounted on said threaded rod by means of a threaded opening in said piston and said actuation means imparts rotation to said threaded rod which causes said piston to move along said threaded rod.

31. A dispenser according to claim 29 further comprising:

an upper molding surface attached to the outlet end of said container.

32. A dispenser according to claim 31 further comprising:

a cap removably positioned on said container over the outlet end, wherein said upper molding surface is attached to said cap.

33. A dispenser according to claim 30, wherein said actuating means comprises:

an actuating wheel positioned proximate the base end and coaxially mounted to said threaded rod, whereby rotation of the actuating wheel turns said threaded rod.

34. A dispenser according to claim 33, wherein the actuating wheel has a hollow interior which defines at least part of said feed passage means.

35. A dispenser according to claim 30, wherein the fluid passage means and the vent opening means are positioned around the threaded opening with the fluid passage means being closer than the vent opening means to the threaded opening.

36. A dispenser according to claim 35, wherein said passage closure means and said vent seal means extend substantially vertically from the base end toward the outlet end, whereby the fluid passage means of said piston sealingly slides over said passage closure means and said vent seal means sealingly projects into the vent opening means when said piston is in the retracted position.

37. A dispenser according to claim 36 further comprising:

a substantially horizontal base wall proximate the base end and connecting said container and said vent seal means.

38. A dispenser according to claim 29, wherein said passage closure means and said vent seal means extend substantially vertically from the base end toward the outlet end, whereby the fluid passage means of said piston sealingly slides over said passage closure means and said vent seal means sealingly projects into the vent opening means when said piston is in the retracted position.

39. A dispenser according to claim 38 further comprising:

a substantially horizontal base wall proximate the base end and connecting said container and said vent seal means.

40. A method for bottom-filling a dispenser comprising:

a container defining a chamber for storing material to be dispensed and extending between a base end and an outlet end;

a threaded rod extending substantially between the base end and the outlet end;

a piston mounted on said threaded rod by means of a threaded opening in said piston and having fluid passage means and vent opening means to enable fluid to pass through said piston;

actuation means positioned to impart rotation to said threaded rod which causes said piston to move within the chamber along said threaded rod between a retracted position adjacent the base end and a fully advanced position adjacent the outlet end;

passage closure means attached to said container and positioned proximate to the base end to close the fluid passage means when said piston is in the retracted position but not when said piston is moved toward the advanced position;

vent seal means attached to said container and positioned proximate to the base end to close the vent opening means when said piston is in the retracted position but not when it is advanced from that position; and an upper molding surface attached to the outlet end of said container, said process in sequence comprising:

advancing said piston from the retracted position;

injecting a molten material from the base end, past the passage closure means, through the fluid passage means, and into the chamber;

returning said piston to the retracted position after the chamber is substantially filled with the molten material; and causing the molten material to solidify, whereby said upper molding surface gives the solidified molten material a molded shape proximate the outlet end.

* * * * *